United States Patent [19]

Langen et al.

[11] Patent Number: 4,922,688

[45] Date of Patent: May 8, 1990

[54] LOAD SETTLING MECHANISM FOR CARTON LOADING MACHINES

[75] Inventors: Marinus J. M. Langen, Rexdale; Peter Guttinger, Milton; Heiner Hoefkes, Mississauga, all of Canada

[73] Assignee: H. J. Langen & Sons Limited, Mississauga, Canada

[21] Appl. No.: 356,514

[22] Filed: May 25, 1989

[51] Int. Cl.[5] ..... B65B 1/22

[52] U.S. Cl. ..... 53/525; 53/252; 53/437; 198/631; 366/218

[58] Field of Search ..... 53/252, 437, 525; 198/631; 366/218

[56] References Cited

U.S. PATENT DOCUMENTS

| | | | |
|---|---|---|---|
| 1,248,465 | 12/1917 | Donnelly | 53/525 X |
| 2,136,901 | 11/1938 | Ferguson | 53/525 |
| 2,826,881 | 3/1958 | Negoro | 53/525 X |
| 3,436,894 | 4/1969 | Sorensen | 53/525 X |
| 3,488,915 | 1/1970 | Delestatius | 53/525 X |
| 3,604,689 | 9/1971 | Hutcheson et al. | 53/525 X |
| 3,990,209 | 11/1976 | Eisenberg | 53/437 |
| 4,198,166 | 4/1980 | Tüns | 53/525 X |
| 4,578,929 | 4/1986 | Tisma | 53/525 |
| 4,744,195 | 5/1988 | Reed | 53/525 X |

FOREIGN PATENT DOCUMENTS

| | | | |
|---|---|---|---|
| 419440 | 8/1974 | U.S.S.R. | 53/525 |

*Primary Examiner*—John Sipos
*Assistant Examiner*—Beth Bianca
*Attorney, Agent, or Firm*—Fetherstonhaugh & Co.

[57] ABSTRACT

In a load transporting conveyor of the type which has a plurality of load confining compartments located thereon which are transported by the conveyor along a load transporting path, there is provided a load settling mechanism. The load settling mechanism includes a load support platform which forms a bottom wall of each compartment. Resilient suspension members support the bottom wall with respect to the conveyor such that it is free to vibrate with respect to the conveyor. A vibration activator mechanism is located along the load transporting path so as to engage successive load support platforms as they are transported along the load transporting path to cause the load support platform to vibrate to thereby vibrate any load which is located thereon to cause the load to settle into the load confining compartment.

14 Claims, 4 Drawing Sheets

LOAD SETTLING MECHANISM FOR CARTON LOADING MACHINES

FIELD OF INVENTION

This invention relates to a load settling mechanism for a carton loading machine.

DESCRIPTION OF RELATED ART

In many carton loading machines, it is necessary to load a flexible pouch which contains loose items into the open end of a carton which has fixed proportions. While it is possible to compress the loaded pouches into a receptacle in order to preform the pouch to the proportions required for loading, the contents of the pouch can be damaged by the pressing or forming action.

SUMMARY OF INVENTION

It is an object of the present invention, to provide a load settling mechanism in a load transporting conveyor which will serve to vibrate the load items to cause them to settle to conform to the proportions of the load transporting compartment in which the load is located.

It is a further object of the present invention to provide a carton loading machine incorporating a load transporting conveyor which has a vibrating load settling mechanism.

According to one aspect of the present invention, there is provided in a load transporting conveyor of the type which has a plurality of load confining compartments located thereon which are transported by the conveyor along a load transporting path, the improvement of load settling means comprising a load support platform forming a bottom wall of each compartment, resilient suspension means supporting said bottom wall with respect to said conveyor such that it is free to vibrate with respect to said conveyor, vibration activator means located along the load transporting path so as to engage successive load support platforms as they are transported along the load transporting path, said vibration activator means being operable to cause the load support platform to vibrate to thereby vibrate any load which is located thereon to cause the load to settle into the load confining compartment.

According to a further aspect of the present invention, there is provided a carton loading machine in which a load transporting conveyor transports load items into a load transfer station in which the load items are transferred into an open end of an end loading carton of the type which has a width and height of fixed proportions and wherein the load items are in the form of pouches which contain loose items, the pouches having flexible walls which permit the width and thickness of the pouch to vary according to the distribution of the load items located therein, said carton loading machine comprising a plurality of load transporting receptacles mounted on the load transfer conveyor, each receptacle comprising a pair of oppositely disposed side walls which are spaced from one another a distance which is substantially equal to the width of the open end of the carton, each side wall having an upper edge, a load support platform forming a bottom wall of each receptacle, resilient suspension means supporting said bottom wall with respect to said conveyor such that it is free to vibrate with respect to said conveyor, vibration activator means located along the load transporting path so as to engage successive load support platforms as they are transported along the load transporting path, said vibration activator means being operable to cause the load support platform to vibrate to thereby vibrate any load which is located thereon to cause the load to settle into the load confining compartment.

BRIEF DESCRIPTION OF DRAWINGS

The invention will be more clearly understood after reference to the following detailed specification read in conjunction with the drawings wherein;

With reference to FIG. 1 of the drawings, the reference numeral 10 refers generally to a carton loading machine constructed in accordance with an embodiment of the present invention.

Figure 1:
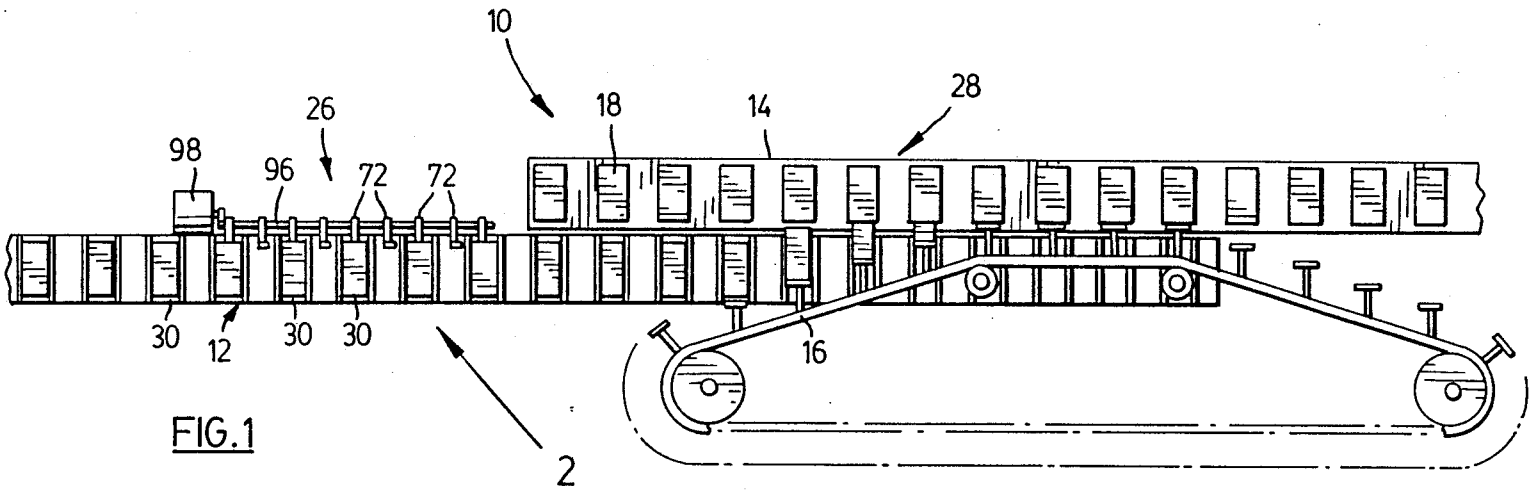
FIG. 1 is a diagrammatic plan view of a carton loading machine constructed in accordance with an embodiment of the present invention.

The carton loading machine 10 includes a load transporting conveyor 12, a carton transporting conveyor 14 and an end loading pusher conveyor 16.

A plurality of end loading cartons 18 are supported on the carton transporting conveyor in an open-ended configuration in a conventional manner which is not shown in detail. The cartons 16 are generally paperboard cartons and the open end of each carton has a fixed width and height.

Figure 2:
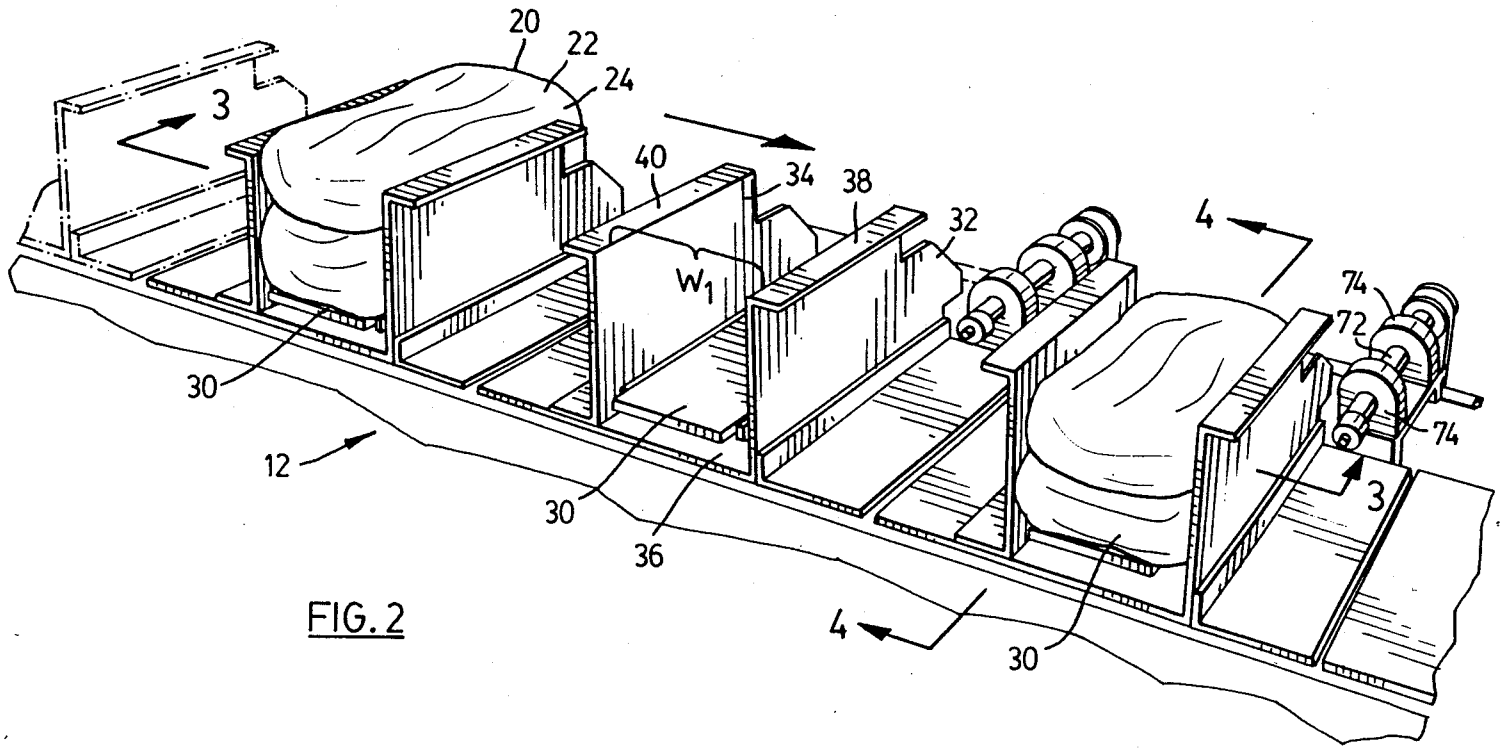
FIG. 2 is a pictorial view of the load settling station taken in the direction arrow 2 of FIG. 1.

As shown in FIG. 2 of the drawings, the load items which are generally identified by the reference numeral 20 may be in the form of a pouch 22 which has flexible walls 24 and which contains loosely packed items such as breakfast cereal flakes or granuals or snack foods such as potato chips. The walls 24 are sufficiently flexible to permit the width and thickness of the pouch to vary according to the distribution of the product which is stored in the pouch.

As shown in FIG. 1 of the drawings, a load settling station which is generally identified by the reference numeral 26 is located in advance of the load transfer station which is generally identified by the reference numeral 28. The load settling station 26 is provided for the purposes of causing the load items to settle within their retaining pouch 22 to conform to the proportions of the open end of the carton into which they are to be transferred in the transfer station.

Figure 4:
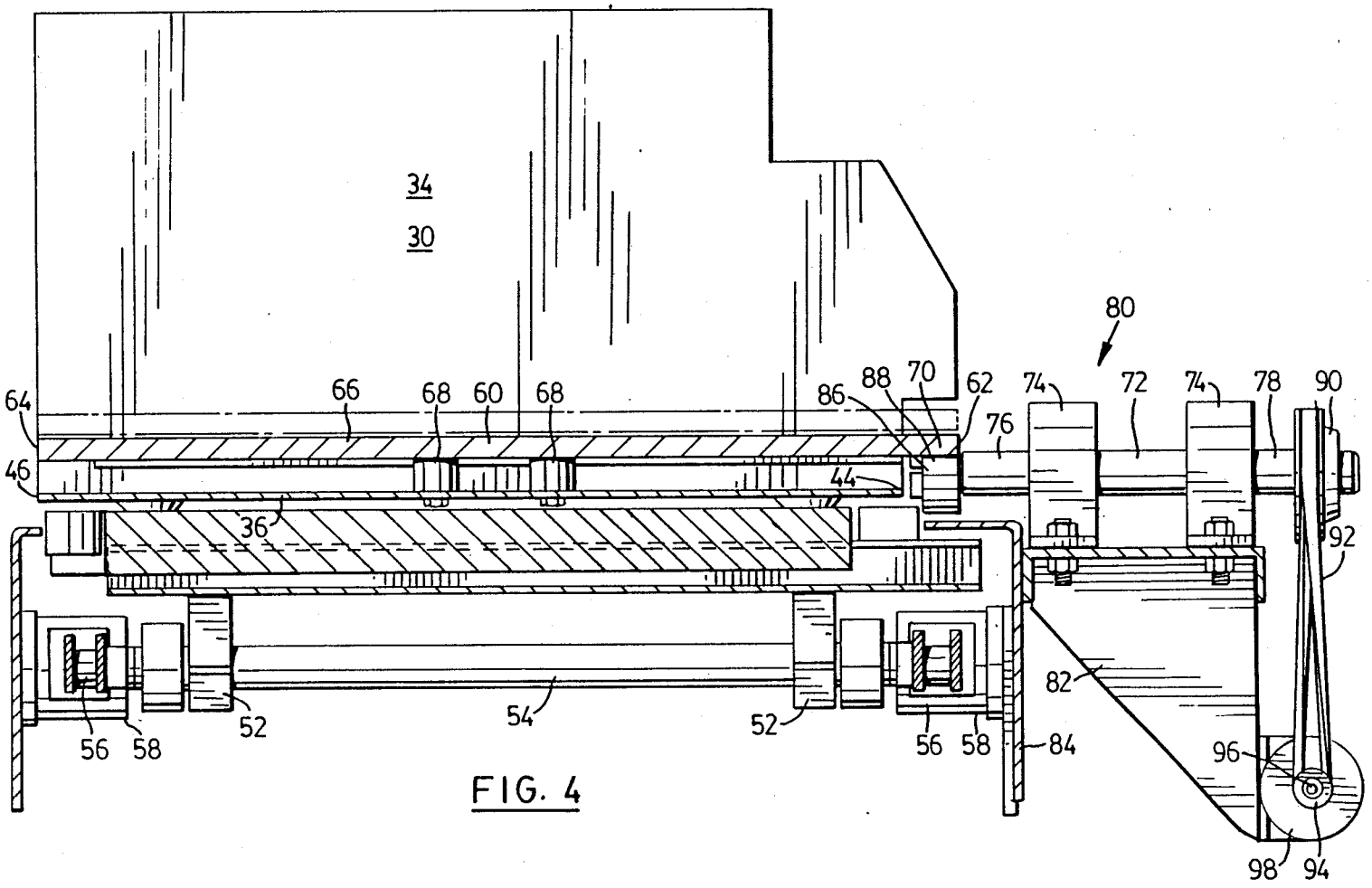
FIG. 4 is a sectional view taken along the line 4—4 of FIG. 2.

As shown in FIG. 2 of the drawings, the load transporting conveyor 12 has a plurality of load storage receptacles 30 mounted thereon. Each load storage receptacle 30 has a load storage compartment 31 formed therein. Each load transporting receptacle 30 comprises a front wall 32, a back wall 34 and a base 36. The front wall 32 and base 36 are both formed from a single sheet of metal which is folded such that the front wall extends at right angles to the bottom wall. The front wall 32 also has a flange portion 38 which projects forwardly from the upper edge thereof. The base 36 has a similar flange 40 which projects rearwardly from the upper edge of the back wall. A wide flange 42 projects rearwardly from the lower edge of the back wall 34. The flange 42 rests upon the base 36 and suitable adjustment means (not shown) is provided which releaseably secures the flange 42 to the base 36 so as to permit adjustment of the width W-1 of the load storage receptacle 30. As shown in FIG. 4 of the drawings, the base 36 has a front edge 44 and a back edge 46.

Figure 3:
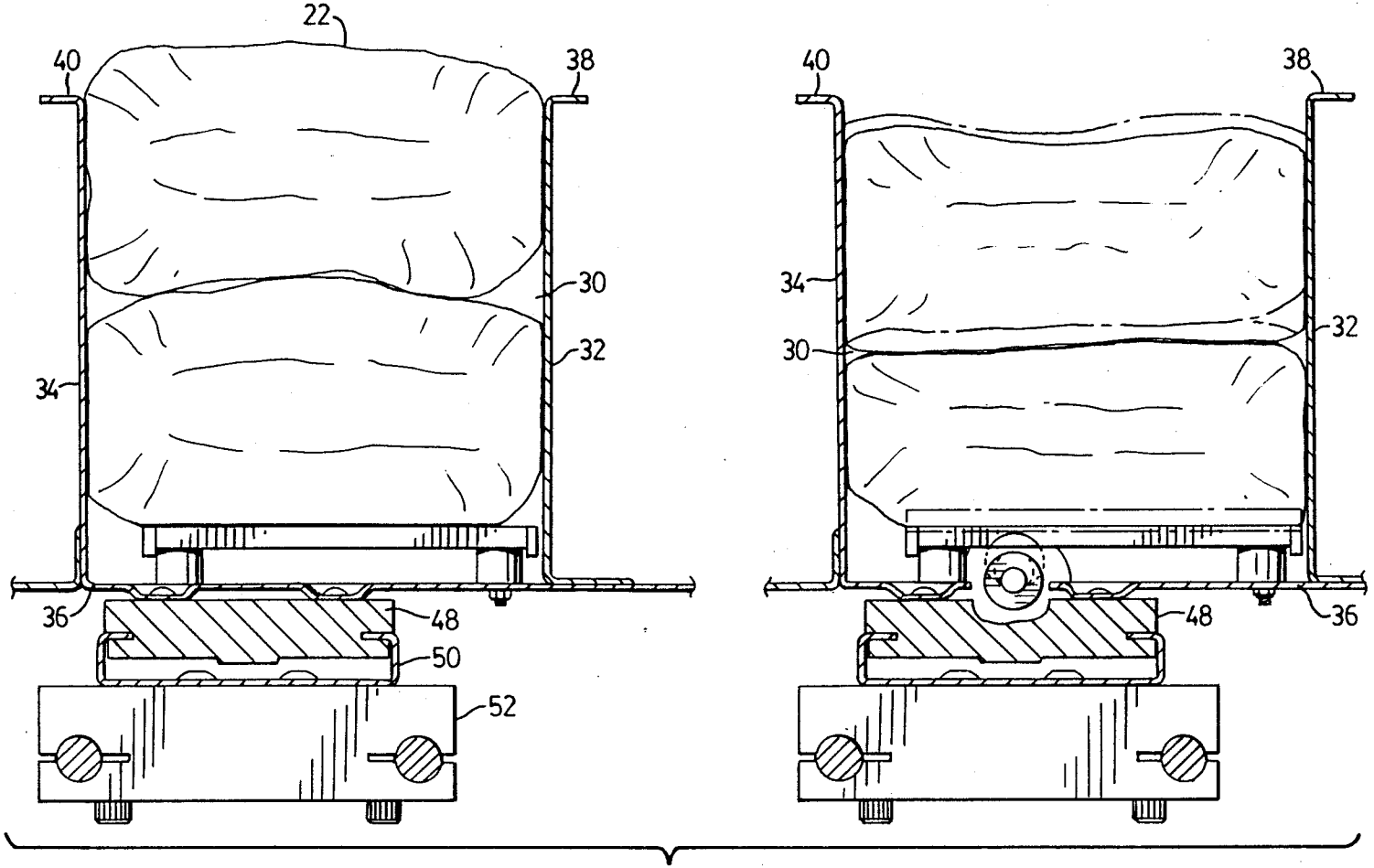
FIG. 3 is a sectional view taken along the line 3—3 of FIG. 2.

As shown in FIGS. 3 and 4 of the drawings, the base 36 of each load storage receptacle 30 is mounted on a base plate 48 which is in turn releaseably mounted on a support frame 50. Brackets 52 serve to secure the support frame 50 to adjacent spaced parallel shafts 54 which are mounted on endless chains 56 which are supported in guide tracks 58. The structure of the load storage compartment which is described briefly above is known and is not therefore described in detail.

In order to cause the load items which are accommodated in each of the load storage receptacles 30 to settle, a load settling mechanism is provided. The load settling mechanism includes a load support platform 60 located in each load storage receptacle 30. A load storage platform 60 has a front edge 62 and a back edge 64 (FIG. 4). The load support platform 60 serves to form a bottom wall 66 of the load storage receptacle 30. The bottom wall 66 is supported in a spaced relationship with respect to the base 36 by means of four resilient suspension pads 68. The pads 68 are located toward the center of the load support platform 60 and are spaced a substantial distance from the front end 62 and the back end 64 of the bottom wall 66. The front end 62 of the bottom wall 66 projects laterally outwardly beyond the front edge 44 of the base 36 to expose the marginal edge portion 70 along the front edge 62 of each support platform 60.

The resilient support pads 68 are preferably in the form of a synthetic rubber pad and they are clamped between the platform 60 and the base 36 and are sufficiently resilient to permit substantial vibration of the platform 60 to occur when it is agitated.

A vibration activator mechanism is generally identified by the reference numeral 80 (FIG. 4) and comprises a plurality of driven shafts 72 which are mounted for rotation in bearings 74. Each shaft 72 has an inner end 76 and an outer end 78. The bearings 74 are mounted on a support bracket 82 which is secured to the frame 84 of the carton loading machine. A cam member 86 is mounted on the inner end 76 of the shaft 72 and has a cam surface 88 which is arranged to be eccentrically located with respect to the axis of rotation of the shaft 72. A pulley 90 is mounted at the outer end 78 of the shaft 72. The pulley 90 is connected by means of a drive belt 92 to a pulley 94 which is mounted on a driven shaft 96 which is drivingly connected to a motor 98. The driven shaft 96 extends along the length of the load settling station 26 as shown in FIG. 1.

In use as each load storage receptacle 30 is driven through the load settling station 26, the marginal edge portion 70 of each successive load support platform 60 will engage each of the eccentric cam members 86 in turn. The rotation of the cam members 86 when in contact with the marginal edge portions 70 will raise and lower the front edge of each platform and will thereby cause each load support platform to vibrate on the resiliently flexible pads 68. The vibration which is caused by this action will serve to cause the loose load items which are located in the pouches 22 to vibrate and this action will cause the particles to settle into closer contact with one another thereby causing the pouches to collapse from the oversized configuration illustrated in the receptacle which is shown to the left of FIG. 3 to assume the more compact configuration shown in the receptacle which is illustrated at the right hand side of FIG. 3.

It has been found that this mechanism is very effective in causing pouches such as pouches containing breakfast cereal and the like to settle from the oversize configuration to the compact configuration without the need to physically compact the pouches with the aid of a compression device which might cause the product to be crushed and thereby destroy the preferred character of the individual items which make up the load.

From the foregoing, it will be apparent that the present invention provides a simple and inexpensive mechanism which promotes load settling.

This mechanism can very easily be incorporated into existing load transporting conveyors because it merely involves the introduction of a false bottom.

We claim:

1. In a load transporting conveyor of the type which has a plurality of load confining compartments located thereon which are transported by the conveyor along a load transporting path, the improvement of load settling means comprising;

(a) a load support platform forming a bottom wall of each compartment, said platform having a marginal edge portion which extends along one edge of the conveyor, (b) at least one resilient support pad supporting said bottom wall with respect to said conveyor, said support pad being spaced a substantial distance from said marginal edge so as to permit a substantial degree of freedom of movement of the marginal edge portion such that the load platform is free to vibrate with respect to said conveyor, (c) vibration activator means located along the load transporting path so as to engage the marginal edge portion of successive load support platforms as they are transported along the load transporting path, said vibration activator means being operable to cause the load support platform to vibrate to thereby vibrate any load which is located thereon to cause the load to settle into the load confining compartment.

2. A load transporting conveyor as claimed in claim 1, wherein a plurality of vibration activators are located at spaced points along the length of the load transporting path to provide a load settling station which has a length in the direction of movement along said path which is greater than the length of each load transporting compartment.

3. A load transporting conveyor as claimed in claim 1, wherein a plurality of vibration activators are located at spaced points along the length of the load transporting path so as to repeatedly activate and deactivate the vibratory motion of the platform to further improve the load settling effectiveness of the platform.

4. A load transporting conveyor as claimed in claim 1, wherein said vibration activator comprising an eccentric cam which is aligned with and arranged to bear against the marginal edge portions of the platforms as the platforms are driven along said load transportation path and drive means for rotatably driving said eccentric cam member such that the eccentric rotation of the cam member causes the platform to vibrate.

5. A load transporting conveyor as claimed in claim 1, wherein each platform has a front end and a back end, said marginal edge portion being located at said front end, said resilient pad being located substantially centrally between the front and back edge of the platform.

6. A load transporting conveyor as claimed in claim 1, wherein said vibration activator means comprises;

(a) a plurality of driven shafts which are mounted at spaced points along the length of the conveyor for rotation about axes which extend at right angles to said load transportation path, each shaft having a first end and a second end, the front end of each shaft being arranged to underlie a path along which the marginal edges of successive platforms travel as the conveyor is driven through a load settling station, the second end of each shaft being spaced outwardly from the conveyor, (b) a cam mounted at the first end of each shaft, said cam having a cam face which is eccentrically oriented with respect to the axis of rotation of its associated drive shaft, said cam face being arranged to bear against the marginal edge of each platform during movement of each support platform through the settling station, (c) a drive shaft extending along said settling station and drivingly connected to each driven shaft for simultaneously driving said driven shafts in response to rotation of said drive shaft.

7. A load transporting conveyor as claimed in claim 1, wherein each load combining compartment comprises;

(a) a U-shaped receptacle having bottom and side walls, said load support platform overlying said bottom wall, said resilient suspension means being mounted on said bottom wall and supporting said support platform in a position in which it is spaced a substantial distance above said bottom wall, said bottom wall and said support platform each having a front edge which extends parallel to a side edge of the conveyor, the front edge of the support platform projecting beyond the front edge of the bottom wall to provide said marginal edge portion on each support platform.

8. A carton loading machine in which a load transporting conveyor transports load items into a load transfer station in which the load items are transferred into an open end of an end loading carton of the type which has a width and height of fixed proportions and wherein the load items are in the form of pouches which contain loose items, the pouches having flexible walls which permit the width and thickness of the pouch to vary according to the distribution of the load items located therein, said carton loading machine comprising;

(a) a plurality of load transporting receptacles mounted on the load transfer conveyor, each receptacle comprising;

(i) a pair of oppositely disposed side walls which are spaced from one another a distance which is substantially equal to the width of the open end of the carton, each side wall having an upper edge.

(ii) a load support platform forming a bottom wall of each receptacle, said platform having a marginal edge portion which extends along one edge of the conveyor, (iii) at least one resilient support pad supporting said bottom wall with respect to said conveyor, said support pad being spaced a substantial distance from said marginal edge so as to permit a substantial degree of freedom of movement of the marginal edge portion such that the load platform is free to vibrate with respect to said conveyor, (iv) vibration activator means located along the load transporting path so as to engage the marginal edge portion of successive load support platforms as they are transported along the load transporting path, said vibration activator means being operable to cause the load support platform to vibrate to thereby vibrate any load which is located thereon to cause the load to settle into the load confining compartment.

9. A carton loading machine as claimed in claim 8, wherein a plurality of vibration activators are located at spaced points along the length of the load transporting path to provide a load settling station which has a length in the direction of movement along said path which is greater than the length of each load transporting compartment.

10. A carton loading machine as claimed in claim 8, wherein a plurality of vibration activators are located at spaced points along the length of the load transporting path so as to repeatedly activate and deactivate the vibratory motion of the platform to further improve the load settling effectiveness of the platform.

11. A carton loading machine as claimed in claim 8, wherein said vibration activator comprising an eccentric cam which is aligned with and arranged to bear against the marginal edge portions of the platforms as the platforms are driven along said load transportation path and drive means for rotatably driving said eccentric cam member such that the eccentric rotation of the cam member causes the platform to vibrate.

12. A carton loading machine as claimed in claim 8, wherein each platform has a front end and a back end, said marginal edge portion being located at said front end, said resilient pad being located substantially centrally between the front and back edge of the platform.

13. A carton loading machine as claimed in claim 8, said vibration activator means comprises;

(a) a plurality of driven shafts which are mounted at spaced points along the length of the conveyor for rotation about axes which extend at right angles to said load transportation path, each shaft having a first end and a second end, the front end of each shaft being arranged to underlie a path along which the marginal edges of successive platforms travel as the conveyor is driven through a load settling station, the second end of each shaft being spaced outwardly from the conveyor, (b) a cam mounted at the first end of each shaft, said cam having a cam face which is eccentrically oriented with respect to the axis of rotation of its associated drive shaft, said cam face being arranged to bear against the marginal edge of each platform during movement of each support platform through the settling station, (c) a drive shaft extending along said settling station and drivingly connected to each driven shaft for simultaneously driving said driven shafts in response to rotation of said drive shaft.

14. A carton loading machine as claimed in claim 8, wherein each load combining compartment comprises;

(a) a U-shaped receptacle having bottom and side walls, said load support platform overlying said bottom wall, said resilient suspension means being mounted on said bottom wall and supporting said support platform in a position in which it is spaced a substantial distance above said bottom wall, said bottom wall and said support platform each having a front edge which extends parallel to a side edge of the conveyor, the front edge of the support platform projecting beyond the front edge of the bottom wall to provide said marginal edge portion on each support platform.

* * * * *